US007958804B2

(12) United States Patent
Badiali

(10) Patent No.: US 7,958,804 B2
(45) Date of Patent: Jun. 14, 2011

(54) SCREWDRIVER HANDLE HAVING REMOVABLE ROTATING CAP

(75) Inventor: John A. Badiali, Englewood, FL (US)

(73) Assignee: Custom Spec Engineering, Inc., Englewood, FL (US)

( * ) Notice: Subject to any disclaimer, the term of this patent is extended or adjusted under 35 U.S.C. 154(b) by 194 days.

(21) Appl. No.: 12/329,734

(22) Filed: Dec. 8, 2008

(65) Prior Publication Data

US 2009/0229427 A1 Sep. 17, 2009

Related U.S. Application Data

(60) Provisional application No. 60/992,803, filed on Dec. 6, 2007.

(51) Int. Cl.
*B25G 1/00* (2006.01)

(52) U.S. Cl. ..... 81/492; 16/430

(58) Field of Classification Search ..... 81/492; 16/430

See application file for complete search history.

(56) References Cited

U.S. PATENT DOCUMENTS

| | | | |
|---|---|---|---|
| 89,755 | A | 5/1869 | Stock |
| 371,225 | A | 10/1887 | Stevens |
| 392,957 | A | 11/1888 | Latulip |
| 687,401 | A | 11/1901 | Morse |
| 796,201 | A | 8/1905 | Frampton |
| 861,010 | A | 7/1907 | Zeman |
| 1,049,650 | A | 1/1913 | Benjamin |
| 1,530,905 | A | 3/1925 | Nance |
| 1,683,484 | A | 9/1928 | Post |
| 1,772,040 | A | 8/1930 | Dunlea |
| 1,816,359 | A | 7/1931 | Carlin |
| 2,324,839 | A | 7/1943 | Haumerson |
| 2,351,705 | A | 6/1944 | Prall |
| 2,564,356 | A | 8/1951 | Dianda |
| 2,635,660 | A | 4/1953 | Dawson |
| 2,707,784 | A | 5/1955 | Erdos |
| 2,743,749 | A | 5/1956 | Huck |
| 2,775,276 | A | 12/1956 | Rossner |
| 2,849,041 | A | 8/1958 | Vetri |
| 3,343,577 | A | 9/1967 | Wagner |
| 3,426,813 | A | 2/1969 | Robertson |
| 4,093,008 | A | 6/1978 | Martin |
| 4,300,607 | A | 11/1981 | Mellinger |
| 4,763,548 | A | 8/1988 | Leibinger et al. |
| 4,846,042 | A | 7/1989 | Wetty |
| 5,431,075 | A | 7/1995 | Cruz et al. |
| 5,526,724 | A | 6/1996 | Bruggeman |
| 5,823,078 | A | 10/1998 | Liu et al. |
| 6,029,315 | A | 2/2000 | Flower |
| 6,170,123 | B1 | 1/2001 | Holland-Letz et al. |
| 6,434,793 | B1 | 8/2002 | Ensson et al. |
| 6,976,413 | B2 | 12/2005 | Hsieh et al. |
| 6,997,088 | B2 | 2/2006 | Hu et al. |
| 7,093,524 | B2 | 8/2006 | Hsieh et al. |
| 7,398,712 | B1 * | 7/2008 | Hsieh ..... 81/177.5 |
| 2004/0123705 | A1 | 7/2004 | Howard |

FOREIGN PATENT DOCUMENTS

| | | |
|---|---|---|
| EP | 0312775 | 4/1989 |

* cited by examiner

*Primary Examiner* — David B Thomas

(74) *Attorney, Agent, or Firm* — Gifford, Krass, Sprinkle, Anderson & Citkowski, P.C.

(57) ABSTRACT

A handle for a tool which provides for simultaneously providing a downward force and a rotating force on the work piece. By providing a cap assembly attachable to the end of the tool having a rotatable top which permits the top to remain fixed while the tool is rotated.

2 Claims, 2 Drawing Sheets

SCREWDRIVER HANDLE HAVING REMOVABLE ROTATING CAP

CROSS-REFERENCE TO RELATED APPLICATIONS

This application claims the benefit of U.S. Provisional Patent Application Ser. No. 60/992,803 filed Dec. 6, 2007, which is incorporated herein by reference.

FIELD OF THE INVENTION

Described herein is a screwdriver handle with a rotatable cap removably mounted on an end of the handle. Specifically, a screwdriver handle may include a hollow interior with an open end that is closable by a removable cap rotatably mounted to the open end.

REFERENCE TO RELATED ART

A screwdriver may typically include a solid handle with a tool shank extending from one end of the handle. The end of the handle opposite the tool shank may be rounded or otherwise shaped so that it may be comfortably grasped by the user (for example when the user is pushing down on the top of the handle). It would, however, be advantageous to develop improvements to this traditional design to assist a user in grasping and using the tool.

BRIEF DESCRIPTION OF THE DRAWINGS

Reference will now be had to the attached drawings wherein like reference numerals refer to like parts throughout and wherein.

DETAILED DESCRIPTION OF THE PREFERRED EMBODIMENTS

Figure 1:
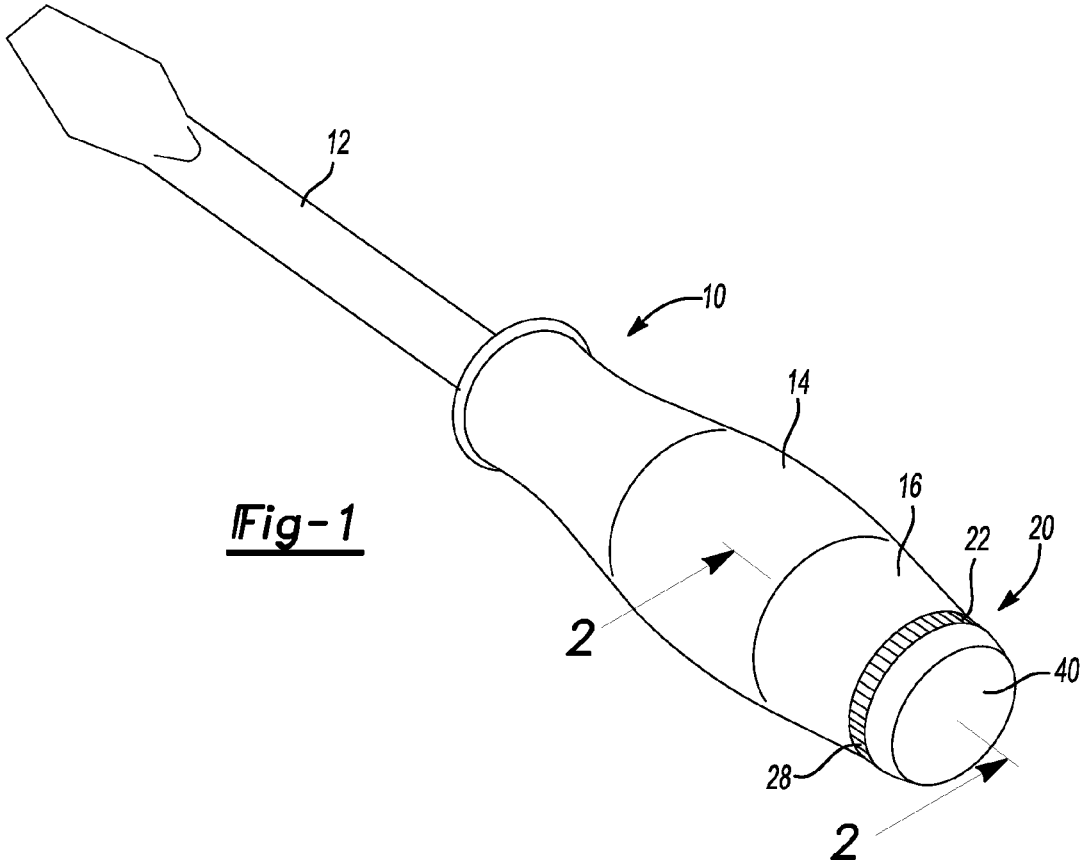
FIG. 1 is a perspective view of a screwdriver incorporating the handle and cap assembly of the present invention.
Figure 2:
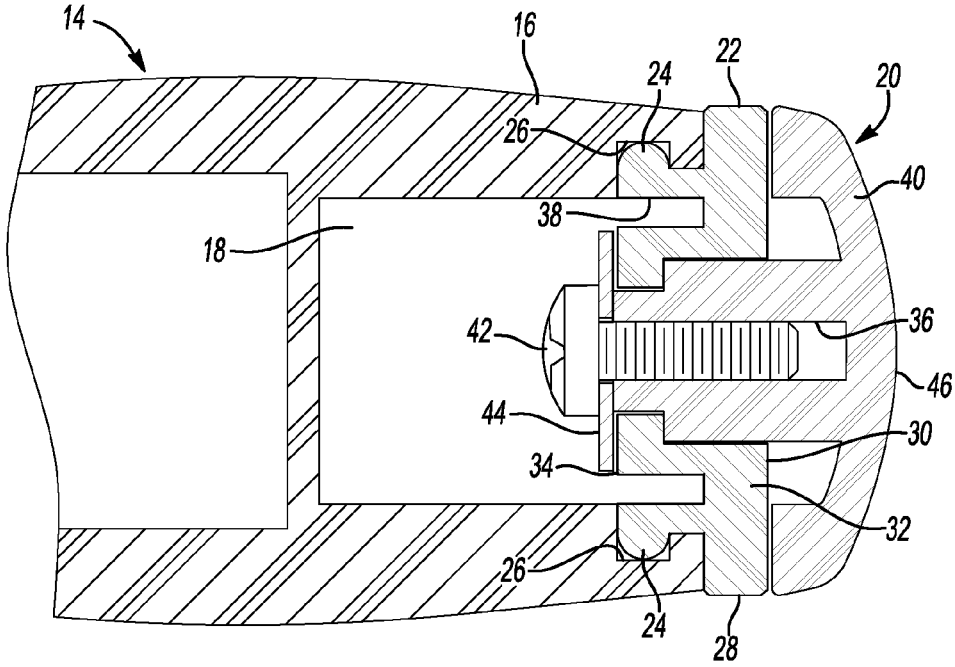
FIG. 2 is a cross-sectional view of a portion of the view of the screwdriver handle and cap assembly of the present invention taken substantially at line 2-2 of FIG. 1.
Figure 4:
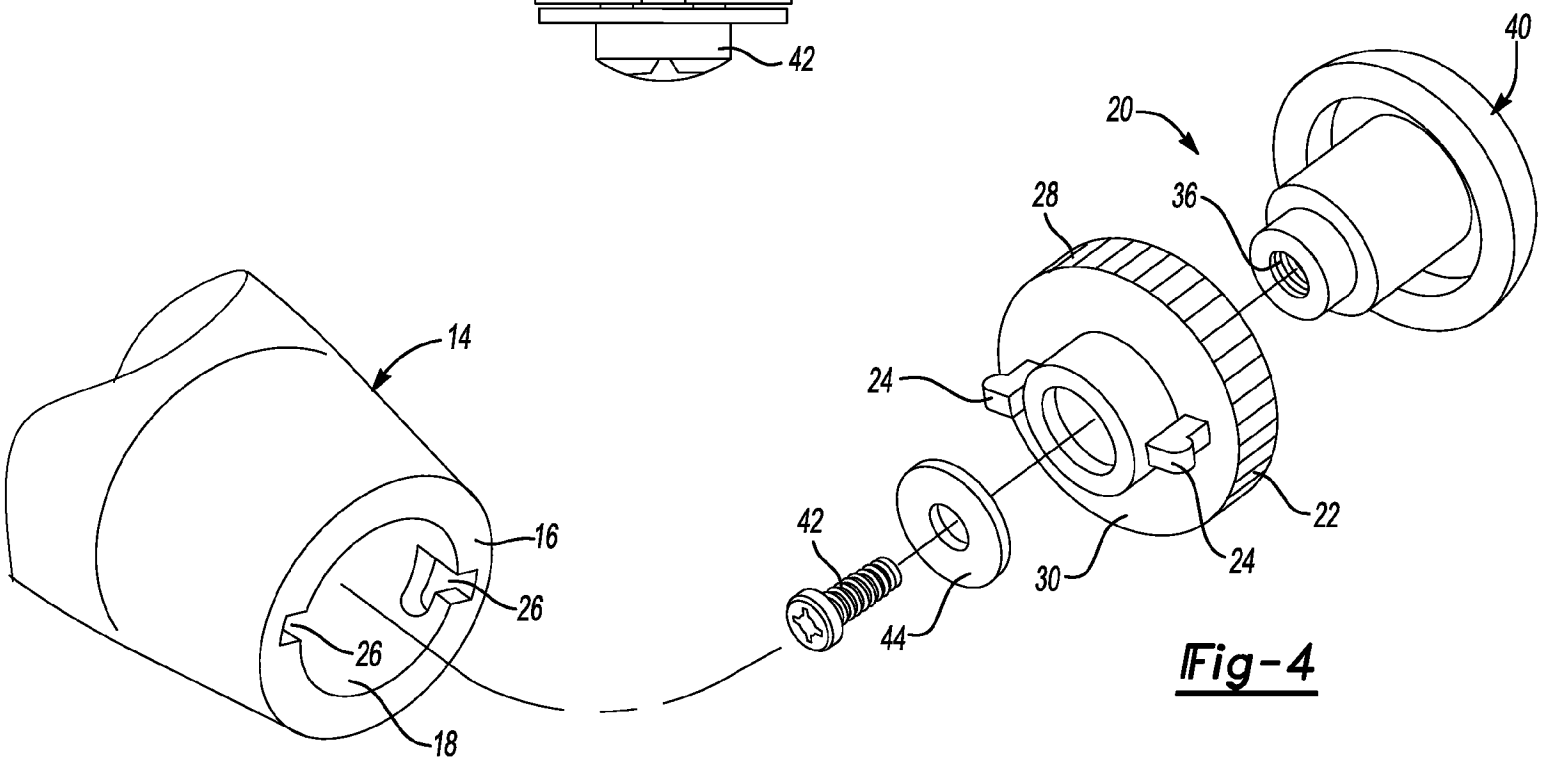
FIG. 4 an exploded view of the improved cap assembly and handle shown in FIG. 2.

Referring now to FIG. 1, a screwdriver 10 includes a tool shank 12 mounted in the conventional fashion to a handle 14. As best seen in FIGS. 2 and 4 the free end 16 of the handle 14 opposite the attachment to the tool shank 12 is open to define a recess 18 extending inwardly into the handle 14 from the free end 16. Further, a cap assembly 20 is removably mounted to the free end 16 of the handle 14 to extend from and close the recess 18. More specifically, the cap assembly 20 includes a base 22 that is removably mounted to the free end 16 of the handle 14 by ears 24 which engage in bayonet slots 26 upon rotation of the base 22 to lock the base 22 to the handle 14. Serrations 28 on the outer surface of the base 22 facilitate rotation of the base 22 to lock and unlock the base 22 from the handle 14.

Still referring to FIGS. 2 and 4, and as best shown in FIG. 2, the base 22 of the cap assembly 20 includes a support 30 closing the recess 18 and having an outer surface 32, an inner surface 34 and a center aperture 36 extending substantially centrally between the outer surface 32 and the inner surface 34. A wall 38 extends from the outer surface 32 of the base 22 and is radially outwardly spaced from the aperture 36. The ears 24 that extend horizontally from the wall 38 engage in the bayonet slots 26 upon rotation of the base 22. In operation, the inner surface 34 of the support 30 of the cap assembly 20 is seated on the end 16 of the handle 14 and extends into the recess 18 to close the recess 18 and to permit the ears 24 to engage in the slots 26 upon rotation of the base 22 to lock the cap assembly 20 to the handle 14.

Figure 3:
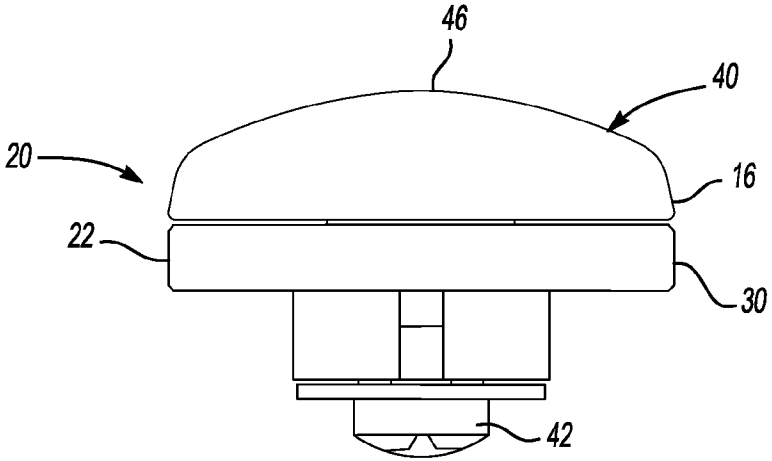
FIG. 3 is an elevational view of the cap assembly of the present invention.

Referring to FIGS. 2, 3 and 4, the top 40 of the cap assembly 20 is rotatably mounted to the base 22 by a fastener 42 and a washer 44 and is seated on the outer surface 32 of the support 30. The top preferably includes a smooth convex outer surface 46.

It should be apparent that the handle 14 of the present invention provides a means of providing leverage in a longitudinal direction as a tool is being rotated to perform work such as removing or tightening a screw. The convex outer surface 46 of the cap assembly 20 provides a convenient surface to push down on the tool while the tool can be rotated beneath the top 40 without it being necessary to reduce the downward force that is being applied. The downward force causes the top 40 to remain fixed while the rest of the tool rotates.

It should also be apparent that although I have described my invention as being especially suitable for use as a handle for a screwdriver it can be used with other tools as well. The tool has special utility where it is desirable to provide a downward force and a rotatable force simultaneously.

Having thus described the above invention various other embodiments will become known to those of skill in the art which do not depart from the scope of the claims set forth below.

The invention claimed is:

1. A hand tool comprising:

a body having a hollow interior and an open end;

a tool mounted to an end of the handle opposite the open end; and a cap removably positioned on the open end of the handle, the cap having a base and a top, the base being removably secured to the open end of the handle and the top being rotatably secured to the base;

said hand tool having a longitudinal axis and said top being rotatably mounted to said base to be rotatable about said longitudinal axis; and said base having a pair of opposed bayonet slots formed in the interior of said handle and said base having a pair of ears fitting in said slots upon rotation of said base to lock said base to said handle.

2. A screwdriver comprising:

a body having a hollow interior and an open end;

a screwdriver tool mounted to an end of the handle opposite the open end; and a cap removably positioned on the open end of the handle, the cap having a base and a top, the base being removably secured to the open end of the handle and the top being rotatably secured to the base;

said screwdriver having a longitudinal axis and said top being rotatably mounted to said base to be rotatable about said longitudinal axis;

said base having a pair of opposed bayonet slots being formed in the interior of said handle and said base having a pair of ears fitting in said slots upon rotation of said base to lock said base to said handle.

* * * * *